US006140779A

United States Patent [19]

Kanazawa et al.

[11] Patent Number: 6,140,779

[45] Date of Patent: Oct. 31, 2000

[54] INCREMENTALLY PREHEATING AND LIGHTING SYSTEM FOR A DISCHARGE LAMP

[75] Inventors: Masaki Kanazawa, Koganei; Hideki Nakamichi, Asaka; Hironobu Sou, Tokorozawa, all of Japan

[73] Assignee: Sanken Electric Co., Ltd., Saitama-Ken, Japan

[21] Appl. No.: 09/228,674

[22] Filed: Jan. 12, 1999

[30] Foreign Application Priority Data

Jan. 16, 1998 [JP] Japan ..... 10-020454
Oct. 28, 1998 [JP] Japan ..... 10-324478

[51] Int. Cl.[7] ..... G05F 1/00

[52] U.S. Cl. ..... 315/291; 315/209 R; 315/362; 315/DIG. 7

[58] Field of Search ..... 315/291, 200 R, 315/209 R, 224, 295, 307, 360, 362, DIG. 5, DIG. 7; 323/247, 355, 901

[56] References Cited

U.S. PATENT DOCUMENTS 5,041,763 8/1991 Sullivan et al. ..... 315/307
5,363,020 11/1994 Chen et al. ..... 315/209 R
5,493,182 2/1996 Sowa et al. ..... 315/291
5,719,471 2/1998 Kachmarik ..... 315/200 R
5,770,926 6/1998 Choi et al. ..... 315/307
5,889,373 3/1999 Fisher et al. ..... 323/247
5,925,990 7/1999 Crouse et al. ..... 315/DIG. 7
5,949,198 9/1999 Nakamura et al. ..... 315/224
5,969,481 10/1999 Konopka ..... 315/209 R

*Primary Examiner*—Don Wong
*Assistant Examiner*—Thuy Vinh Tran
*Attorney, Agent, or Firm*—Woodcock Washburn Kurtz Mackiewicz & Norris LLP

[57] ABSTRACT

A lighting system for a fluorescent lamp includes an inverter circuit having a pair of outputs between which is connected a resonant circuit of an inductor and a capacitor in series, with the discharge lamp connected in parallel with the capacitor. An inversely frequency dependent voltage is applied between the lamp electrodes according to a predefined resonance characteristic. During a preheat period, which precedes a lightup period during which the lamp is to be lit up with the commencement of an electric discharge between the lamp electrodes, the voltage is made lower in the first half than in the second, thereby averting the sudden flow of a large preheating current through the filamentary lamp electrodes.

18 Claims, 8 Drawing Sheets

INCREMENTALLY PREHEATING AND LIGHTING SYSTEM FOR A DISCHARGE LAMP

BACKGROUND OF THE INVENTION

This invention relates to lighting systems for discharge lamps, and pertains more particularly to a lighting system having an inverter and associated means for control of the inverter output frequency for harmlessly and quickly lighting up a discharge lamp as typified by a fluorescent lamp.

It has been known and practiced to incorporate an inverter in discharge lamp lighting systems for higher lighting efficiency and other purposes, as disclosed for example in Japanese Unexamined Patent Publication No. 63-175389. Such conventional lighting systems are alike in having a serial resonant circuit of an inductor and a capacitor connected across an inverter, with the discharge lamp connected in parallel with the capacitor. The discharge lamp has its pair of filamentary electrodes connected in series with the capacitor in order to be preheated.

The magnitude of the current flowing through the LC resonant circuit is frequency dependent, growing to a maximum at a resonance frequency and diminishing in both increasing and decreasing directions from that frequency, because both inductor and capacitor of the resonant circuit inherently possess resistive components. Consequently, the voltage across the capacitor also maximizes at the resonance frequency, which may be in the range of 50–60 kHz, and diminishes in both directions from that frequency. The discharge lamp will therefore be lit up as the inverter output frequency is decremented toward the resonance frequency from a certain higher value, thereby causing a gradual rise in the voltage across the capacitor until an electric discharge starts between the lamp electrodes.

As is well known, an electron radiating substance is coated on the filamentary electrodes of the discharge lamp. In a lighting system including an inverter, the lamp electrodes are preheated as aforesaid, instead of being suddenly subjected to a voltage high enough to initiate an electric discharge therebetween, in order to prevent the electron radiating substance from vaporizing or scattering away from the filaments. Conventionally, the lamp electrodes were preheated for a prescribed period of time by maintaining the voltage across the capacitor at a constant value less than the voltages applied during the subsequent lightup period. The lamp was then lit up by, as aforesaid, decrementing the inverter output frequency and thereby incrementing the voltage across the capacitor until the lamp starts glowing with the commencement of a discharge between the lamp electrodes.

The above conventional practice, briefly holding the inverter output frequency constant for preheating the filamentary lamp electrodes and then decrementing the frequency for lighting up, have proved unsatisfactory for accomplishing the objectives for which it is intended. Experiment has proved that the scattering or vaporizing of the electron radiating substance does take place even by the sudden flow of a preheating current of reduced magnitude through the filaments, making the useful life of the lamp significantly shorter than in the presence of more sophisticated preheating technology.

SUMMARY OF THE INVENTION

The present invention aims, therefore, at the provision of advanced preheating technology designed to make the service life of fluorescent or like discharge lamps longer than heretofore.

The invention also seeks to attain the first recited objective and, at the same time, to make it possible to light up the lamps in a minimum of time.

Briefly, the invention may be summarized as a discharge lamp lighting system comprising an inverter circuit having a pair of outputs to be connected respectively to a pair of electrodes of a discharge lamp for providing a variable frequency output voltage. Connected to the inverter circuit, a resonant circuit includes a capacitor with which the lamp is to be connected in parallel, in order to cause an inversely frequency dependent voltage to be applied between the lamp electrodes according to a predefined resonance characteristic, the resonant circuit having a resonance frequency which is less than a discharge start frequency at which the lamp is to start glowing. Also included are preheat timer means for providing a preheat signal indicative of a preheat period during which the lamp is to be preheated, and lightup timer means for providing a lightup signal indicative of a lightup period during which the lamp is to be lit up. Connected between the preheat timer means and the inverter circuit, preheat control means is responsive to the preheat signal for changing, during the preheat period, the frequency of the output voltage of the inverter circuit from a first frequency to a second frequency which is less than the first frequency, the first and the second frequencies being both higher than the discharge start frequency of the lamp and holding the lamp unlit. Lightup control means is connected between the lightup timer means and the inverter circuit and responsive to the lightup signal for changing, during the lightup period following the preheat period, the frequency of the output voltage of the inverter circuit from the second frequency to a third frequency which is less than the discharge start frequency of the lamp, in order that the lamp may start glowing by the time the output voltage of the inverter circuit reaches the third frequency.

The invention particularly features, in the foregoing summary, the fact that the preheat control means is so made as to cause a drop from the first to the second frequency in the inverter output voltage during the preheat period preceding the lightup period. Since the voltage impressed across the lamp by the inverter circuit via the resonant circuit is inversely proportional to the inverter output frequency, the frequency drop in the inverter output voltage during the preheat period means that the voltage across the lamp is lower at the beginning than at the end of the preheat period. There is accordingly no sudden flow of an inconveniently large preheating current through the lamp electrodes, realizing a longer life of the lamp.

The lamp electrodes should be sufficiently but harmlessly preheated during the preheat period, but this preheat period should not be so long as to introduce a significant delay in the time required for lamp glowing. Thus, in one preferred embodiment of the invention, the inverter output voltage is held at the first frequency during the first half of the preheat period and at the second frequency during the second half. Preheated only in two steps, first to a relatively low temperature and then to a sufficiently high temperature, the lamp electrodes will nevertheless suffer far less degradation than heretofore.

During the subsequent lightup period, the mean rate of change from the second to the third frequency is made higher (more then two times in a preferred embodiment) than that of change from the first to the second frequency during the lightup period. The lamp will therefore start glowing in a relatively short period of time despite the introduction of the incremental preheating process.

The above and other objects, features and advantages of this invention and the manner of realizing them will become more apparent, and the invention itself will best be understood, from a study of the following description and attached claims, with reference had to the attached drawings showing some preferable embodiments of the invention.

DESCRIPTION OF THE PREFERRED EMBODIMENTS

General

Figure 1:
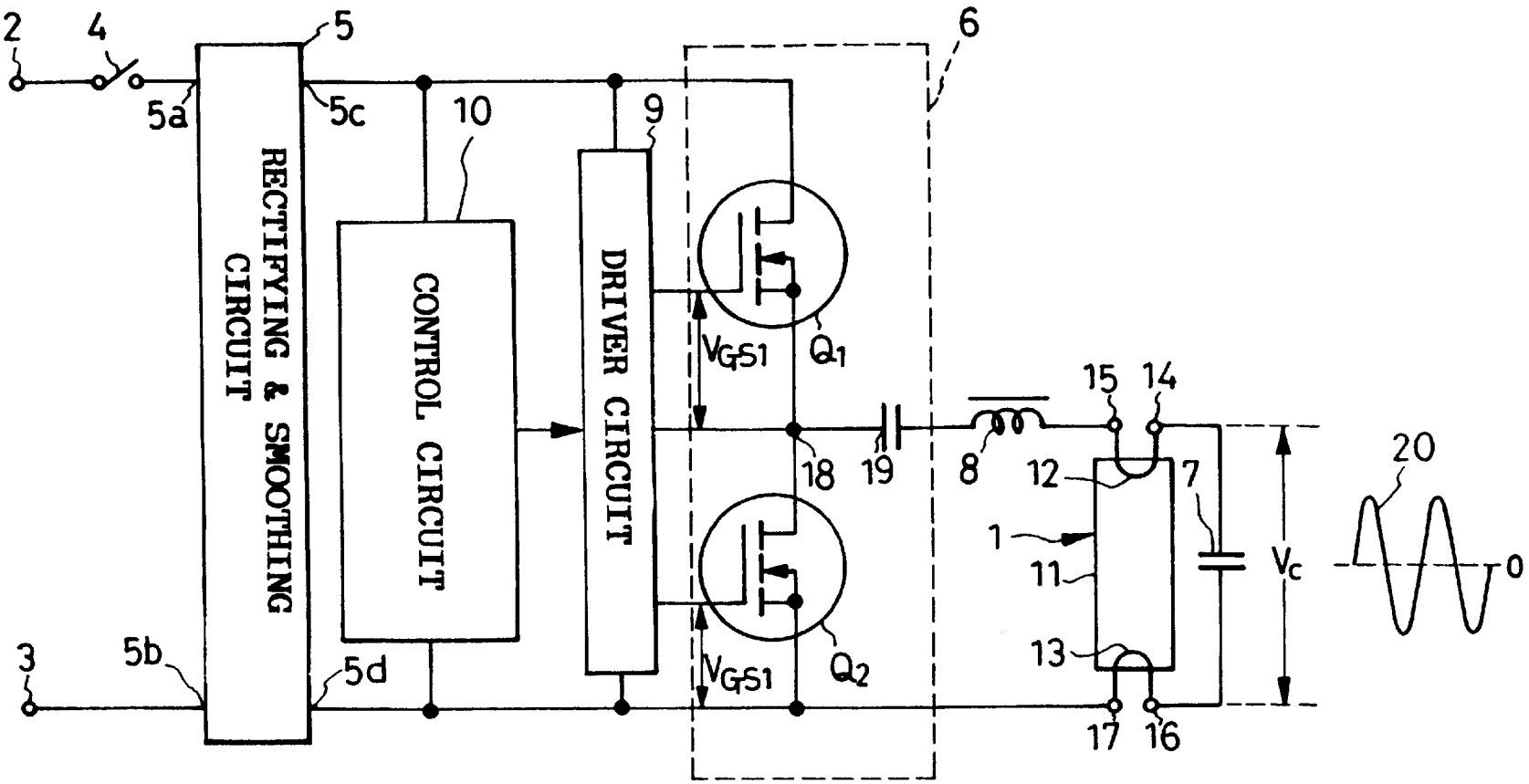
FIG. 1 is a schematic electrical diagram, partly in block form, of the discharge lamp lighting system embodying the principles of the present invention.

The invention will now be described more specifically in terms of the first preferred form of discharge lamp lighting system illustrated in its entirety in FIG. 1. Herein shown adapted for lighting up a familiar fluorescent lamp 1 powered from a pair of commercial alternating current supply terminals 2 and 3 via a power switch 4, the lighting system broadly comprises a rectifying and smoothing circuit 5 connected to the a.c. supply terminals 2 and 3 for providing a direct current, an inverter circuit 6 for reconverting the d.c. input from the rectifying and smoothing circuit into an a.c. output, a capacitor 7 and a inductor 8 forming in combination a resonance circuit, an inverter driver circuit 9, and an inverter control circuit 10 for providing a variable frequency signal to the inverter driver circuit 9 in order to control the frequency of the a.c. output from the inverter circuit 6 as required for preheating, lighting up, and continuously glowing the lamp 1 according to the principles of this invention.

Hereinafter in this specification the fluorescent lamp 1, the rectifying and smoothing circuit 5, the inverter circuit 6, the resonance circuit of capacitor 7 and inductor 8, the inverter driver circuit 9, and the inverter control circuit 10 will be discussed in more detail under the separate headings. The operational description of the complete lighting system will follow the discussion of the listed components.

Lamp

The fluorescent lamp 1 is of any known or suitable make typically having a tubular envelope 11 of vitreous material with a fluorescent coating on its inner surface, and a pair of filamentary electrodes 12 and 13 at the opposite ends of the envelope. Both electrodes 12 and 13 bear electron radiating coatings. The electrode 12 is shown connected between a pair of terminals 14 and 15, and the other electrode 13 between another pair of terminals 16 and 17. It is understood that the fluorescent lamp 1 is replaceable, being coupled to the terminals 14–17 through a conventional plug-and-socket connection.

Rectifying and Smoothing Circuit

The rectifying and smoothing circuit 5 is shown to have a first input 5*a* connected to one commercial a.c. supply terminal 2 via the power switch 4, and a second input 5*b* coupled directly to the other a.c. supply terminal 3. Conventionally comprising a diode rectifier circuit and a smoothing capacitor, both not shown, the rectifying and smoothing circuit 5 provides a unidirectional voltage between a pair of d.c. supply terminals 5*c* and 5*d*

Inverter Circuit

The inverter circuit 6 comprises a pair of electronic switches Q and $Q_2$ connected in series between the pair of d.c. output terminals 5*c* and 5*d* of the rectifying and smoothing circuit 5, and a coupling capacitor 9 connected to the junction 18 between the switches $Q_1$ and $Q_2$. Greater in capacitance than the resonance capacitor 7, the coupling capacitor 19 is inserted in the output line of the inverter circuit 6. The electronic switches $Q_1$ and $Q_2$ are shown as well known metal oxide semiconductor field-effect transistors (MOS FETs) each having a source electrode connected to both source and body regions and essentially comprising a field-effect transistor and a diode inversely connected in parallel therewith. Alternately turned on and off, the pair of MOS FET switches $Q_1$ and $Q_2$ conventionally functions to translate the d.c. voltage from the rectifying and smoothing circuit 5 into an a.c. voltage, indicated by the waveform designated 20 in FIG. 1, for application to the fluorescent lamp 1.

Resonance Circuit

The resonance capacitor 7 is connected both to the terminal 14 on one extremity of one filamentary electrode 12 of the lamp 1 and to the terminal 16 on one extremity of the other lamp electrode 13. Thus the resonance capacitor 7 is in series with the lamp electrodes 12 and 13 and in parallel with the impedance between the lamp electrodes. Consequently, the voltage Vc across the capacitor 7 is impressed between the pair of lamp electrodes 12 and 13.

Shown as a coil with a core, the resonance inductor 8 is connected via the coupling capacitor 19 between the junction 18 of the inverter switches $Q_1$ and $Q_2$ and the lamp terminal 15. The lamp terminal 17 is connected to the source electrode of the second MOS FET switch $Q_2$. The resonance capacitor 7 and the resonance inductor 8 are therefore interconnected in series, forming a serial resonant circuit.

Incidentally, the inductor 8 is connected in series with the fluorescent lamp 1, too, when the latter is glowing. This inductor could be connected between the source of the second MOS FET switch $Q_2$ and the lamp terminal 17. The coupling capacitor 19 could also be connected between the source of the second MOS FET switch $Q_2$ and the lamp terminal 17. Irrespective of whether the lamp 1 is lit or unlit, a current flows through the lamp electrodes 12 and 13 as long as the inverter circuit 6 is in operation, because the serial circuit is always completed which comprises the inductor 8, first lamp electrode 12, resonance capacitor 7 and second lamp electrode 13. Thus the resonance capacitor 7 performs the function of causing the lamp electrodes 12 and 13 to be preheated when the lamp is unlit.

As has been mentioned, the coupling capacitor 19 is greater in capacitance than the resonance capacitor 7, so much so that the capacitance of the coupling capacitor 19 is negligible in computing the resonance frequency in the output circuit of the inverter circuit 6. The lamp electrodes 12 and 13 can be considered electrically disconnected from each other when the lamp 1 is unlit, so that it is the capacitance of the resonance capacitor 7 and the inductance of the inductor 8 that determine the resonance frequency of the serial resonance circuit during that time. When the lamp 1 is glowing, on the other hand, the resonance frequency is determined by the impedance of the lamp in addition to the capacitance of the capacitor 7 and the inductance of the inductor 8.

Figure 4:
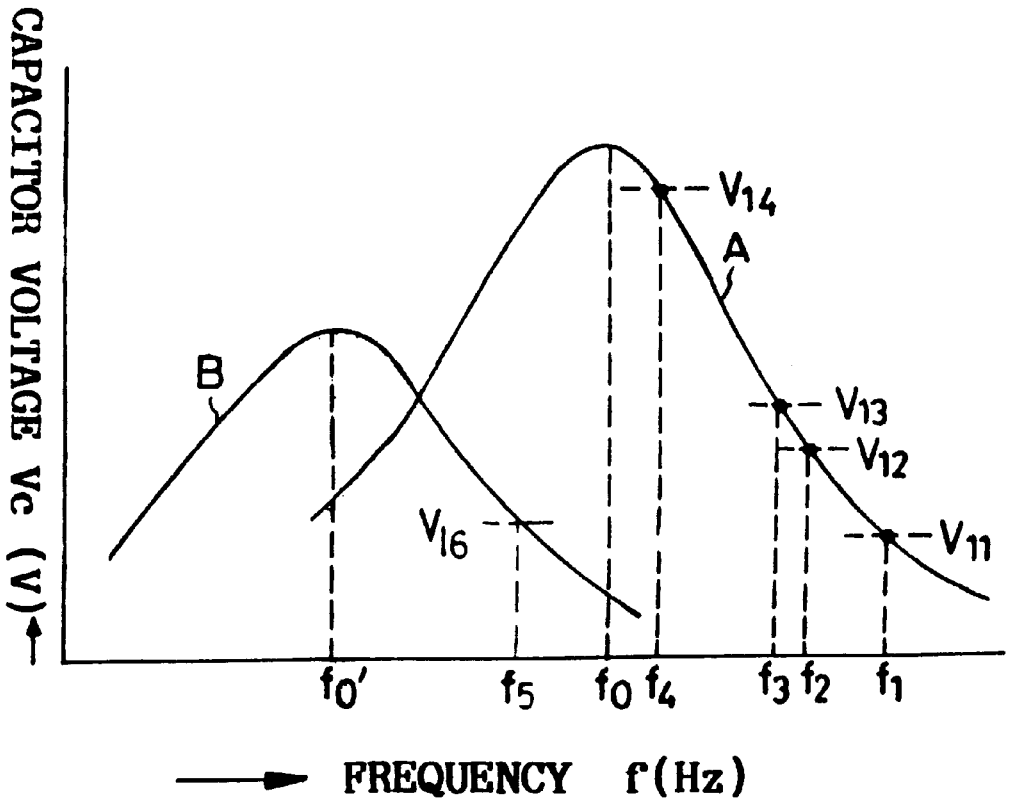
FIG. 4 is a graph plotting the curves of the resonance capacitor voltage against the inverter output frequency when the lamp is lit and unlit.

Graphically represented in FIG. 4 are the relations between the frequency f of the output voltage of the inverter circuit 6 and the voltage Vc across the resonance capacitor 7. The curve A is the f-Vc characteristic when the lamp 1 is unlit, and the curve B that when the lamp is glowing. The curves A and B indicate that the capacitor voltage Vc is frequency dependent, being the highest, when the lamp is unlit, at the resonance frequency $f_0$ (e.g. 50–60 kHz). Below this resonance frequency the capacitor voltage Vc is in direct proportion to the inverter output frequency f and, above that frequency, in inverse proportion thereto.

The present invention utilizes the frequency range of the curve A above the resonance frequency $f_0$, where the capacitor voltage Vc is inversely dependent upon the inverter output frequency f, for soft-starting, preheating, and lighting up the lamp 1. The frequency values $f_1$–$f_5$ and voltage values $V_{11}$–$V_{15}$ indicated in FIG. 4 will be referred to in the course of the operational description of this embodiment to be set forth subsequently.

Inverter Driver Circuit

Figure 3:
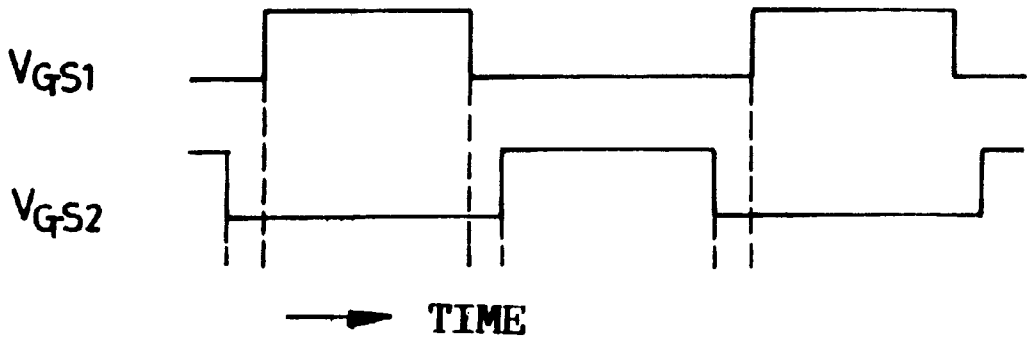
FIG. 3 is a diagram of the waveforms of the gate-source voltages applied from the inverter driver circuit to the pair of switches of the inverter circuit in the FIG. 1 discharge lamp lighting system.

The inverter driver circuit 9 has outputs connected to the gates and sources of the MOS FET inverter switches $Q_1$ and $Q_2$, conventionally providing signals for on-off control of these inverter switches. The gate-source voltages $V_{GS1}$ and $V_{GS2}$ of the MOS FETs $Q_1$ and $Q_2$ are as represented in FIG. 3.

Inverter Control Circuit

Connected to the inverter driver circuit 9, the inverter control circuit 10 functions to control the frequency of the a.c. output from the inverter circuit 6 through control of the rate at which the inverter switches $Q_1$ and $Q_2$ are turned on and off. Despite the showing of FIG. 1 the inverter driver circuit 9 and the inverter control circuit 10 need not be separate circuits but could be integrated into what might be called an inverter switch control circuit.

Figure 2:
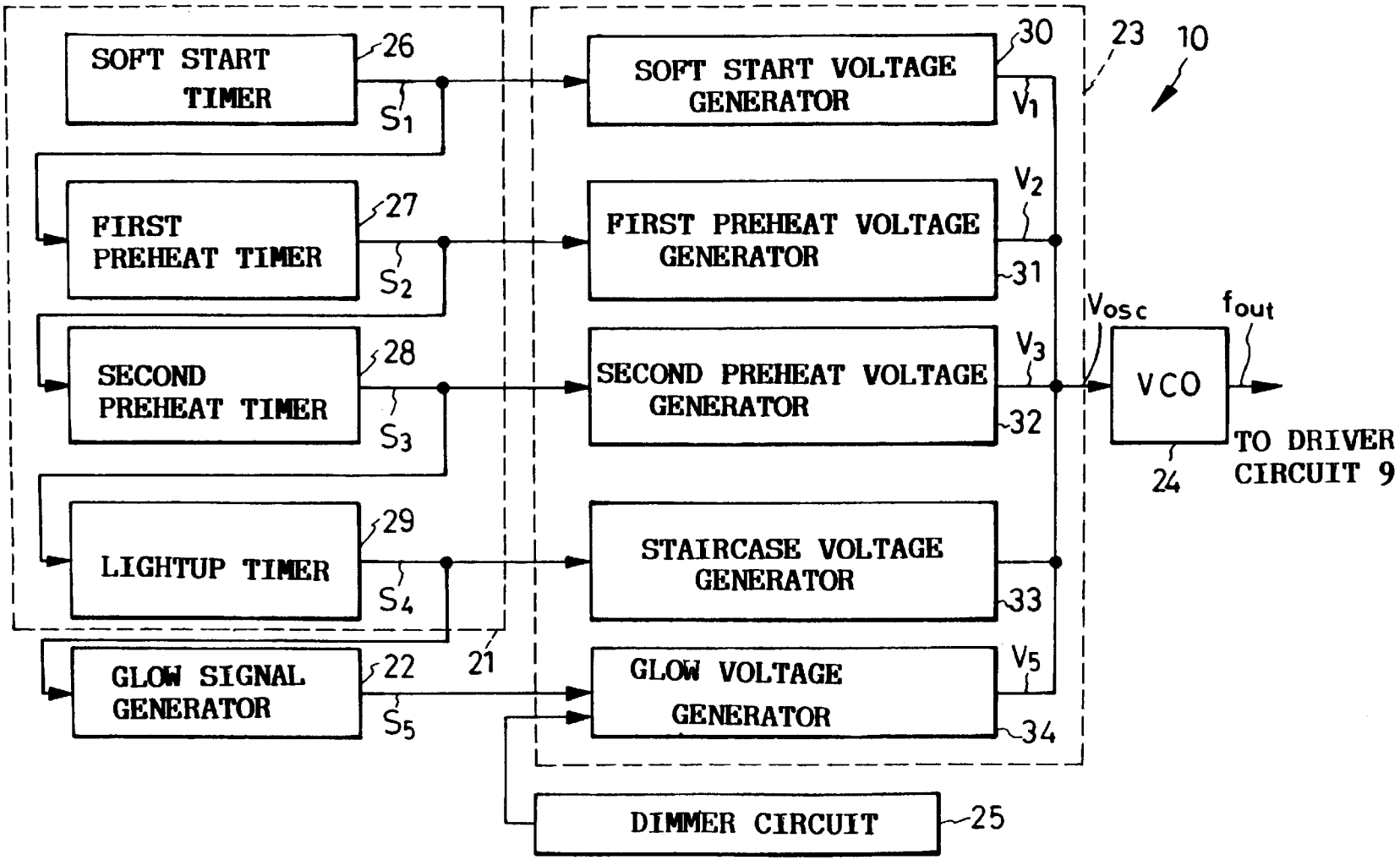
FIG. 2 is a block diagram of the inverter control circuit in the FIG. 1 discharge lamp lighting system.

As illustrated in greater detail in FIG. 2, the inverter control circuit 10 may be subdivided into timer means 21, a glow signal generator circuit 22, voltage generator means 23, a voltage controlled oscillator (VCO) 24, and a dimmer or intensity control circuit 25. The timer means 21 include a soft start timer 26, a first preheat timer 27, a second preheat timer 28, and a lightup timer 29. The voltage generator means 23 include a soft start voltage generator 30, a first preheat voltage generator 31, a second preheat voltage generator 32, a staircase voltage generator 33, and a glow voltage generator 34.

The soft start timer 26 has its output connected to both the soft start voltage generator 30 and the first preheat timer 27. The first preheat timer 27 has its output connected to both the first preheat voltage generator 31 and the second preheat timer 28. The second preheat timer 28 has its output connected to both the second preheat voltage generator 32 and the lightup timer 29. The lightup timer 29 has its output connected to both the staircase voltage generator 33 and the glow signal generator circuit 22. The glow signal generator circuit 22 has its output connected to the glow voltage generator 34, to which there is also connected the output of the dimmer circuit 25. The outputs of all the voltage generators 30–34 are connected to the VCO 24. The output of the VCO 24 is connected to the inverter driver circuit 9. The output frequency of the VCO 24 is therefore equal to that of the inverter circuit 6.

Operation

The operation of the FIGS. 1 and 2 lamp lighting system will be better understood by referring also to FIG. 4 explained above and to FIG. 5, a diagram of waveforms appearing at various parts of the FIGS. 1 and 2 system. Upon closure of the power switch 4, FIG. 1, the soft start timer 26 of the inverter control circuit 10 will put out a pulse $S_1$ of duration $T_1$ (e.g. 10 milliseconds) from time $t_0$ to $t_1$ in FIG. 5, for application to both the soft start voltage generator 30 and the first preheat timer 27.

The soft start voltage generator 30 will respond to this soft start pulse $S_1$ by producing a voltage that gradually drops from a first value $V_1$ at $t_0$ to a second value $V_2$ at $t_1$. Thereupon the VCO 24 will respond in turn to this gradually diminishing input voltage by putting out a frequency signal $f_{out}$, shown also in FIG. 5, that correspondingly drops from a first frequency $f_1$ (e.g. 200 kHz) at $t_0$ to a second frequency $f_2$ (e.g. 90 kHz) at $t_1$.

The inverter driver circuit 9, FIG. 1, will alternately turn the pair of MOS FET switches $Q_1$ and $Q_2$ of the inverter circuit 6 on and off at a rate determined by the output frequency $f_{out}$ of the VCO 24. Therefore, as has been mentioned, the output frequency f of the inverter circuit 6 will always be the same as the output frequency $f_{out}$ of the VCO 24, dropping from the first frequency $f_1$ at $t_0$ to the second frequency $f_2$ at $t_1$.

Figure 5:
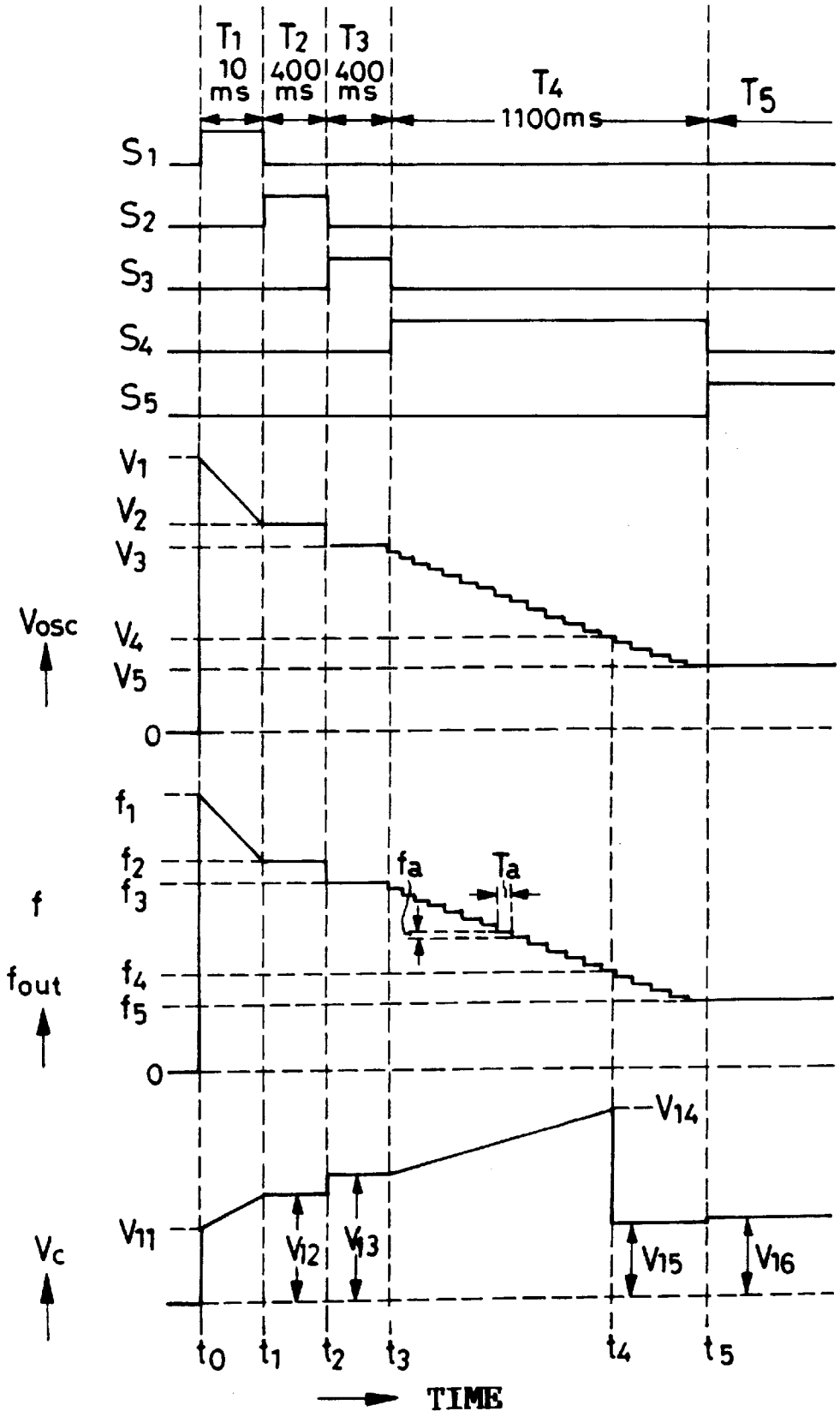
FIG. 5 is a diagram of waveforms that appear at various parts of FIGS. 1 and 2 and that are useful in explaining the operation of the FIG. 1 discharge lamp lighting system.

The effective value of the voltage Vc across the capacitor 7 will be $V_{11}$, as in both FIGS. 4 and 5, upon closure of the power switch 4 at $t_0$ when the a.c. voltage of the relatively high frequency $f_1$ is impressed to the resonant circuit of capacitor 7 and inductor 8 in series. It is understood that in the illustrated embodiment, an electric discharge occurs in the fluorescent lamp 1 when the capacitor voltage Vc is $V_{14}$, which is much higher than the values $f_1$–$f_2$ during the $t_0$–$t_1$ period. The lamp 1 is not lit up during this period. The capacitor voltage $V_{11}$ at $t_0$ in particular is made very low compared to the discharge start voltage $V_{14}$ in order to avoid a sudden application of such a voltage as might do harm to the filamentary lamp electrodes 12 and 13. No rushing current is therefore to flow through the capacitors 7 and 19 upon closure of the power switch 4.

Thus the $t_0$–$t_1$ period $T_1$ may be called a soft start period, and the voltage $V_{11}$ a soft start voltage. Being intended to protect the lamp electrodes 12 and 13 from a rushing current upon closure of the power switch, the soft start period $t_0$–$t_1$ can be very brief, normally to be set somewhere between five and twenty milliseconds.

The first preheat timer 27, on the other hand, will respond to the trailing edge of the soft start pulse $S_1$ by putting out a pulse $S_2$ which indicates by its duration a first preheat period $T_2$ lasting from $t_1$ to $t_2$. Immediately following the soft start period $T_1$, the first preheat period $T_2$ is much longer, typically 400 milliseconds. The first preheat pulse $S_2$ is applied to both the first preheat voltage generator 31 and the second preheat timer 28.

Inputting the first preheat pulse $S_2$, the first preheat voltage generator 31 will produce a voltage $V_2$ of constant magnitude during the $t_1$–$t_2$ duration of that pulse. The output frequency $f_{out}$ of the VCO 24, and therefore the output frequency f of the inverter circuit 6, will therefore be constant at $f_2$ during the first preheat period $T_2$. The resulting voltage Vc across the capacitor 7 during the first preheat period $T_2$ will be $V_{12}$, which is higher than the soft start voltage $V_{11}$ but still less than the discharge start voltage $V_{14}$.

The lamp 1 will therefore be unlit but preheated during the first preheat period $T_2$. The first preheat voltage $V_{12}$ is only a little more than the soft start voltage $V_{11}$, much less than the discharge start voltage $V_{14}$, so that the resulting current flowing through the filamentary lamp electrodes 12 and 13 for preheating them is not of such great magnitude as to cause the evaporation or exfoliation of the electron radiating substance coated thereon.

Also inputting the first preheat pulse $S_2$, the second preheat timer 28 will respond to its trailing edge and put out a second preheat pulse $S_3$ of the duration $T_3$, lasting from $t_2$ to $t_3$. The second preheat period $T_3$ is of the same length as the first $T_2$ in this particular embodiment. The second preheat pulse $S_3$ is applied to both the second preheat voltage generator 32 and the lightup timer 29.

In response to the second preheat pulse $S_3$ the second preheat voltage generator 32 will produce a voltage $V_3$ of constant magnitude during the $t_2$–$t_3$ duration of that pulse, for delivery to the VCO 24. Both the output frequency $f_{out}$ of the VCO 24 and the output frequency f of the inverter circuit 6 will be constant at $f_3$ during the second preheat period $T_3$. Just as the VCO input voltage $V_3$ during this second preheat, period $T_3$ is only slightly less than the VCO input voltage $V_2$ during the $t_1$–$t_2$ first preheat period $T_2$, so the resulting third frequency $f_3$ will be correspondingly less than the second frequency $f_2$. If this second frequency is 90 kHz, as has been mentioned, then the third frequency $f_3$ may be 80 kHz. The voltage Vc across the capacitor 7 during the second preheat period $T_3$ will be $V_{13}$, a little higher than the first preheat voltage $V_{12}$ but still significantly less than the discharge start voltage $V_{14}$. The lamp 1 will remain unlit, and be kept preheated, during the second preheat period $T_3$.

Thus the 800 milliseconds preheat period, from $t_1$ to $t_3$, is shown subdivided into the 400 milliseconds first preheat period $T_2$ and the 400 milliseconds second preheat period $T_3$. The capacitor voltage $V_{12}$ during the first preheat period $T_2$ is less than the capacitor voltage $V_{13}$ during the second preheat period $T_3$, thereby, here again, avoiding the sudden flow of a higher preheating current through the lamp filaments 12 and 13 at the start of the preheat period at $t_1$.

With the subdivision of the preheat period into the two halves $T_2$ and $T_3$ as above, the inverter output frequency f is set at 90 kHz during the first half and at 80 kHz at the second half. Since the frequency difference between the two halves is 10 kHz, the mean rate of frequency change during the total $t_1$–$t_3$ preheat period is as low as 12.5 Hz/msec (=10 kHz/800 msec). Broadly speaking, however, the mean rate of frequency change during the total preheat period may be from about five to about 20 Hz/msec. The length of the total preheat period is not limited to 800 msec, either, but can range from about 500 to about 1000 msec.

Inputting the second preheat pulse $S_3$ from the second preheat timer 28, the lightup timer 29 will put out a lightup pulse $S_4$ in response to the trailing edge of the input pulse. The duration of the lightup pulse $S_4$ dictates the length of the lightup period $T_4$ during which the lamp 1 is to be lit up. The lightup period $T_4$ is, typically, 1100 msec long, lasting from $t_3$ to $t_5$. The lightup pulse $S_4$ is applied to both the staircase voltage generator 33 and the glow signal generator circuit 22.

During this lightup period $T_4$ as defined by the duration of the incoming lightup pulse $S_4$, the staircase voltage generator 33 will produce a staircase voltage that decrements from $V_3$ at $t_3$ to $V_5$ at $t_5$ through a series of discrete steps. In response to this staircase voltage the VCO 24 will produce a frequency signal $f_{out}$ that also decrements from the third frequency $f_3$ at $t_3$ to the fifth frequency $f_5$ at $t_5$.

As has been stated, the lamp 1 is assumed to start glowing at the discharge start voltage $V_{14}$ in FIG. 5. It is also indicated in this waveform diagram that the discharge start voltage $V_{14}$ is reached when the VCO output signal $f_{out}$ has the fourth frequency $f_4$. Let this fourth, or discharge start, frequency $f_4$ be 60 kHz, it being understood that the third frequency $f_3$ is 80 kHz. Then the fifth frequency $f_5$ should be 50 kHz or so. It is now apparent that the lamp 1 will invariably start glowing as the VCO output frequency decrements from $f_3$ to $f_5$ during the lightup period $T_4$. As will be noted by referring back to FIG. 4, the discharge start frequency $f_4$ is slightly higher than the resonance frequency $f_0$, which is 55 kHz in the illustrated embodiment.

Specifically, in this particular embodiment of the invention, the VCO 24 provides eighteen discrete frequency steps during the lightup period $T_4$. The time duration Ta of each step is 61 msec, and a frequency difference fa from one step to the next is 1.6 kHz. The mean rate of frequency change during the lightup period $T_4$ is 27 Hz/msec, more than twice as high as that (12.5 Hz/msec) during the preheat period $t_1$–$t_3$. Consequently, in the lightup period $T_4$, the discharge start frequency $f_4$ at which the lamp 1 is to start glowing will be reached relatively quickly.

The step-by-step frequency difference fa of the staircase frequency signal during the lightup period $T_4$ should be less than the frequency difference (10 kHz in the illustrated embodiment) from the second frequency $f_2$ in the first preheating period $T_2$ to the third frequency $f_3$ in the second preheating period $T_3$. The 1.6 kHz frequency difference fa set forth above is exemplary; broadly, it can be in the range of from about 0.5 kHz to about 5.0 kHz.

The time duration Ta of each frequency step of the staircase signal f or $f_{out}$ during the lightup period $T_4$ should be much less than that (400 msec in the illustrated embodiment) of each preheating period $T_2$ or $T_3$. The 61 msec duration set forth above is also exemplary; in practice, it can be in the range of from about five msec to about 100 msec.

The length of the lightup period $T_4$ should be from about 1000 msec to about 1500 msec, any longer period being objectionable from the standpoint of quick lighting of the lamp. The mean rate of frequency change in the lightup period $T_4$ should be from about 20 to about 40 Hz/msec.

In the practice of the invention, commercially available fluorescent lamps may start glowing not exactly at the specified voltage but in a certain range of different voltages in its neighborhood. Such lamps will nevertheless be infallibly lit up according to this invention as the frequency f or $f_{out}$ is decremented past the specified discharge start frequency. Moreover, since no great difference occurs from one frequency step to the next in the lightup period $T_4$, the useful life of the filamentary electrodes 12 and 13 of the lamp 1 is not to be shortened during this period, as during the soft start period $T_1$ and preheat periods $T_2$ and $T_3$.

The fluorescent lamp 1 of the illustrated embodiment will start glowing at $t_4$ when the inverter output frequency drops to $f_4$, causing the capacitor voltage Vc to rise to the discharge start voltage $V_{14}$. Thereupon the capacitor voltage Vc will drop to $V_{15}$ with a drop in the impedance between the lamp electrodes 12 and 13. A resonance circuit will be formed instead which comprises the lamp 1, the capacitor 7 and the inductor 8.

At B in FIG. 4 is shown the resonance characteristic when the lamp 1 is lit up. FIG. 4 is rather explanatory, however, instead of illustrative of exact details, with both frequency and voltage axes partly expended and partly contracted. The waveforms of FIG. 5 are also shown partly expanded and partly contracted, in order to better represent the features of the invention.

The lightup pulse $S_4$ from the timer 29 is also directed as aforesaid into the glow signal generator circuit 22. The glow signal $S_5$ produced by this circuit 22 will go high at $t_5$ in response to the trailing edge of the lightup pulse $S_4$.

Inputting the glow signal $S_5$, the glow voltage generator 34 will provide a constant voltage $V_5$ to the VCO 24. The resulting output $f_{out}$ from the VCO 24 will be fixed at a fifth frequency $f_5$ (e.g. 50 kHz) and remain at this frequency during the glow period $T_5$ which starts at $f_5$ and which continues as long as the lamp 1 is glowing, provided that the dimmer circuit 25 is left untouched. It is understood that the fifth frequency $f_5$ is higher than the resonance frequency $f_0'$, FIG. 5, when the lamp is glowing. The capacitor voltage Vc during the glow period $T_5$ will be $V_{16}$.

Connected to the glow voltage generator 34, the dimmer circuit 25 permits intensity control of the lamp 1 by changing the glow voltage $V_5$. The capacitor voltages $V_{15}$ and $V_{16}$ after $t_4$ are therefore subject to change.

Thus, in this first preferred form of lamp lighting system, the two preheat periods $T_2$ and $T_3$ are provided, and the inverter output frequency f is made lower in the second period $T_3$ than at the first $T_2$, with a view to a longer service life of the lamp 1. Further the difference between the inverter output frequencies $f_2$ and $f_3$ in the two preheat periods $T_2$ and $T_3$ is set at 10 kHz whereas the difference between the inverter output frequencies $f_3$ and $f_5$ at the beginning and end of the lightup period $T_4$ is much higher, 30 kHz. This difference assures both the efficient, harmless preheating of the lamp and the infallible lighting thereof. As an additional advantage, in the lightup period $T_4$, the rate of change from one frequency to the next is made higher than that in the preheat periods $T_2$ and $T_3$, in order that the discharge start frequency $f_4$ may be reached as quickly as possible.

Second Form

Figure 6:
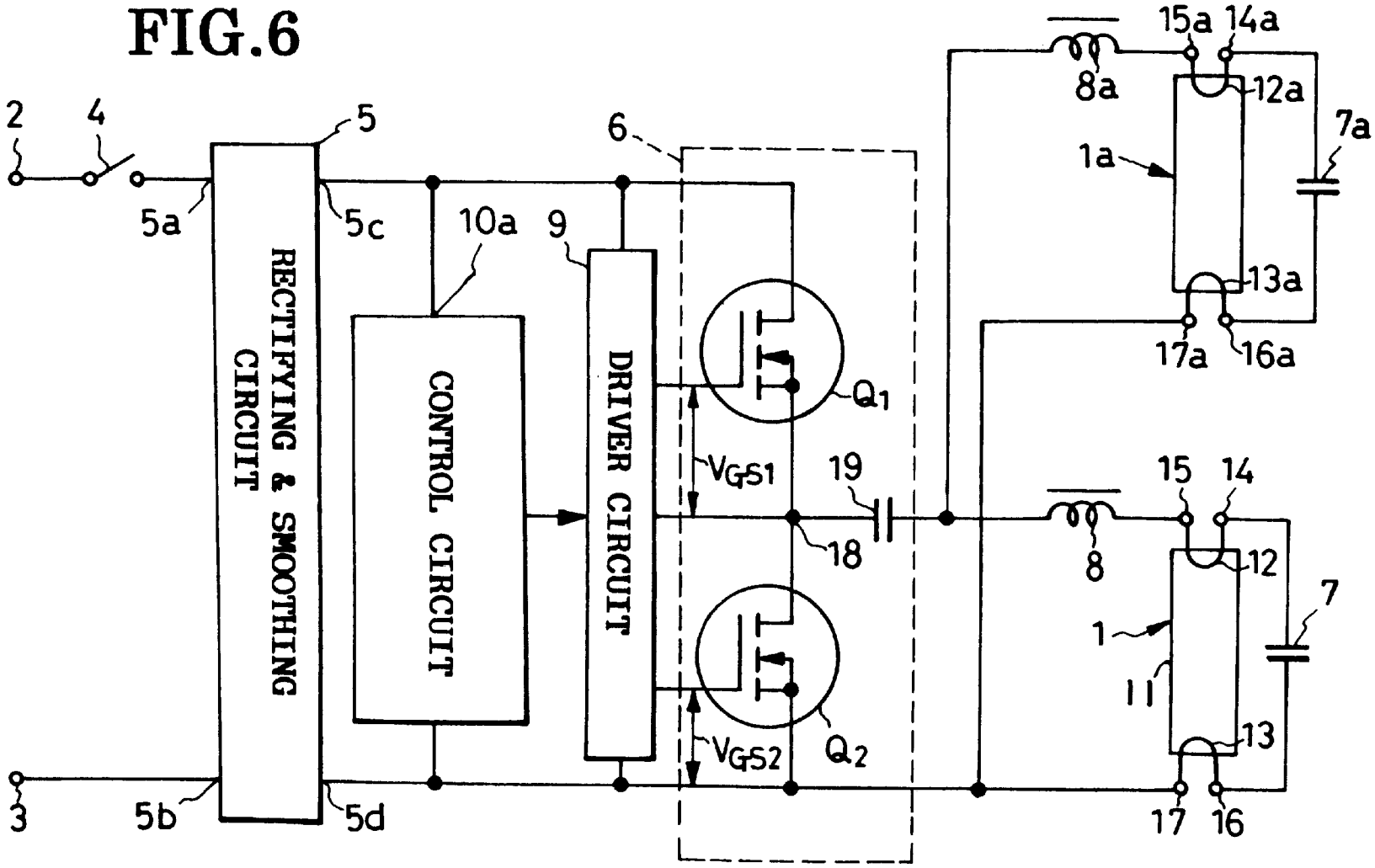
FIG. 6 is a schematic electrical diagram, partly in block form, of another preferred form of discharge lamp lighting system according to the present invention.

In FIG. 6 the lighting system according to this invention is shown adapted for lighting two fluorescent lamps 1 and 1*a*. This second lamp lighting system differs from the FIGS. 1–5 system in having a slightly modified inverter control circuit 10*a* and in that an additional circuit comprising the second lamp 1*a*, a second resonance capacitor 7*a* and a resonance inductor 8*a* is connected between the pair of outputs of the inverter circuit 6. The other details of construction are as previously set forth with reference to FIGS. 1 and 2.

The second lamp 1*a* is identical with the first lamp 1, having a first filamentary electrode 12*a* connected between terminals 14*a* and 15*a*, and a second filamentary electrode 13*a* connected between terminals 16*a* and 17*a* The second capacitor 7*a* and second inductor 8*a* are also similar, at least in construction, to the first capacitor 7 and first inductor 8, respectively.

Possibly, in cases where two or more lamps are connected to one and the same inverter circuit as in FIG. 6, there may be dissimilarities, due for example to manufacturing errors, between the internal impedances of the lamps, the capacitances of the capacitors, and the inductances of the inductors. In the presence of such dissimilarities the lamps might not be lit up at the same inverter output frequency because of different performance characteristics of the two resonant circuits. The FIG. 6 system incorporates the modified inverter control circuit 10*a* such that the difference between the moments the lamps 1 and 1*a* are lit up will be reduced to a minimum.

Constructionally, the modified inverter control circuit 10*a* is the same as the FIG. 2 circuit 10 but operationally differs therefrom in the magnitude of the input voltage signal $V_{osc}$ of the VCO 24 during the lightup period, and, in consequence, in the VCO output frequency $f_{out}$ and the inverter output frequency f during that period.

Figure 7:
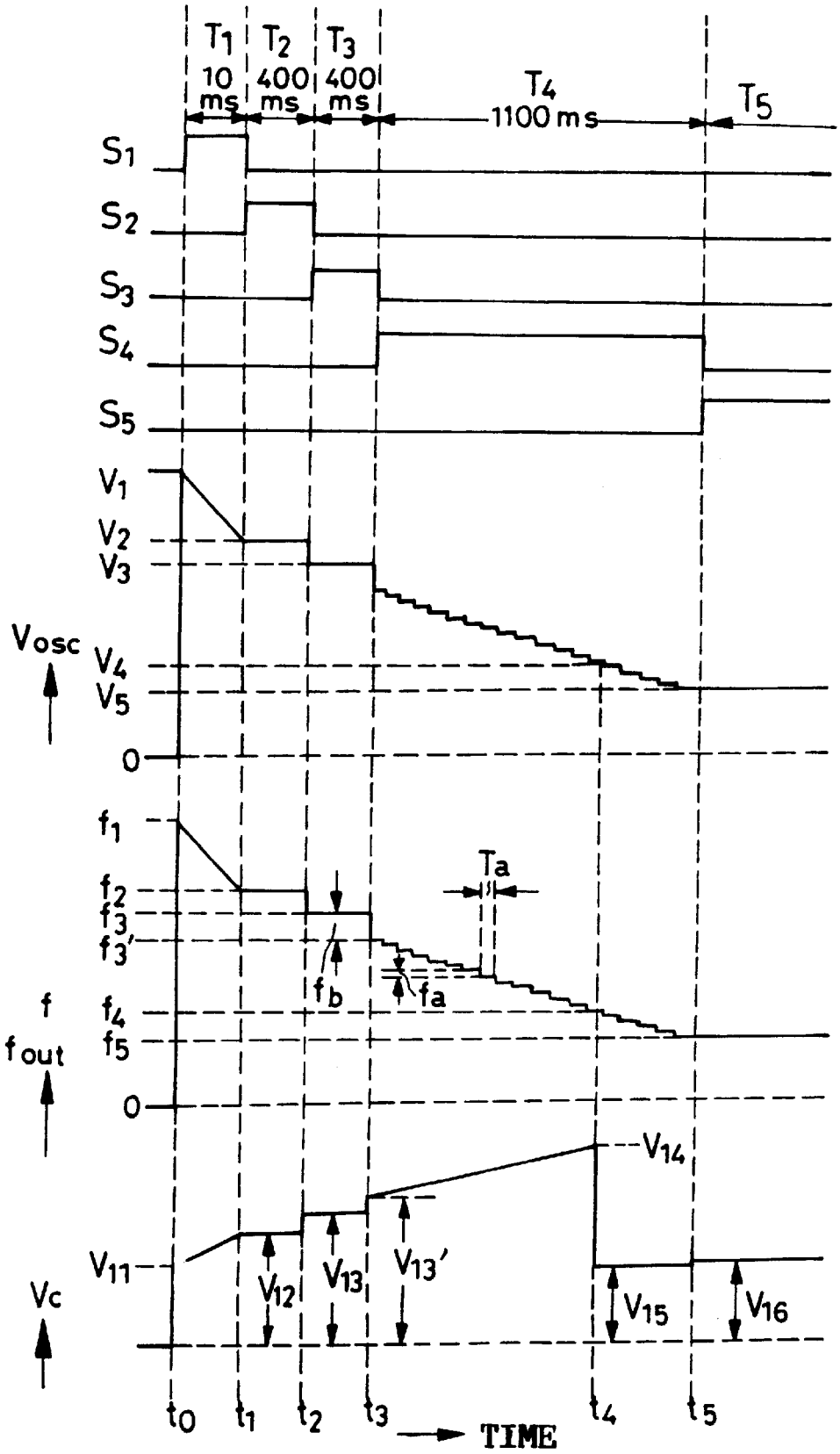
FIG. 7 is a diagram of waveforms useful in explaining the operation of the FIG. 6 system.

How the modified circuit 10*a* operationally differs from the original circuit 10 will be better understood from a comparison of FIG. 5, a waveform diagram explanatory of the operation of the FIG. 1 system, and FIG. 7, a similar diagram explanatory of the operation of the FIG. 6 system. In FIG. 5 the frequency difference fa at $t_3$, the moment of transition from second preheat period $T_3$ to lightup period $T_4$, is the same as the differences between the successive staircase frequencies of the lightup period $T_4$. By contrast, in FIG. 7, a frequency drop fb is made to occur at $t_3$, the frequency drop being greater than the differences fa between the staircase frequencies of the lightup period $T_4$.

Typically, in this second embodiment of the invention, the frequency drop fb at $t_3$ is eight kHz, or 10% of the inverter output frequency $f_3$ (80 kHz) during the second preheat period $T_3$. The first step frequency $f_3'$ of the staircase frequency signal during the lightup period $T_4$ is therefore 72 kHz. The $t_3$–$t_5$ lightup period $T_4$ is 1100 msec long, and the frequency $f_5$ at $t_5$ is 50 kHz, both as in the first disclosed embodiment. Consequently, the mean rate of frequency change during the lightup period $T_4$ is 20 Hz/msec. Also as in the first embodiment, the duration Ta of each frequency step in the lightup period $T_4$ is set at 61 msec, and there are eighteen steps in the lightup period, so that the frequency change fa from one step to the next is 1.2 kHz.

Speaking broadly, however, the duration Ta of each step of the staircase frequency signal in the lightup period $T_4$ can range from about five to 100 msec, and the step-by-step frequency change fa from about 0.5 to 5.0 kHz, both as in the first embodiment. The frequency drop fb at $t_3$ can also range from about five to about 20% of the inverter output frequency $f_3$ during the second preheat period $T_3$, and from about twice to about twenty times the step-by-step frequency change fa of the staircase signal.

In short this second embodiment features a greater drop in the inverter output frequency f at the beginning of the lightup period $T_4$ than in the previous embodiment. The greater frequency drop will cause a sudden increase in the magnitude of the current flowing through the filamentary lamp electrodes 12 and 13, preheating them to a higher temperature and making them readier for discharge.

Thus, possible differences between the impedances of the lamps 1 and 1*a*, and between the capacitances and inductances of the associated resonant circuits, the two lamps will start glowing with a minimum of time lag. The sudden increase in current magnitude must of course be less than a limit beyond which the lamp electrodes might suffer degradation.

Third Form

Figure 8:
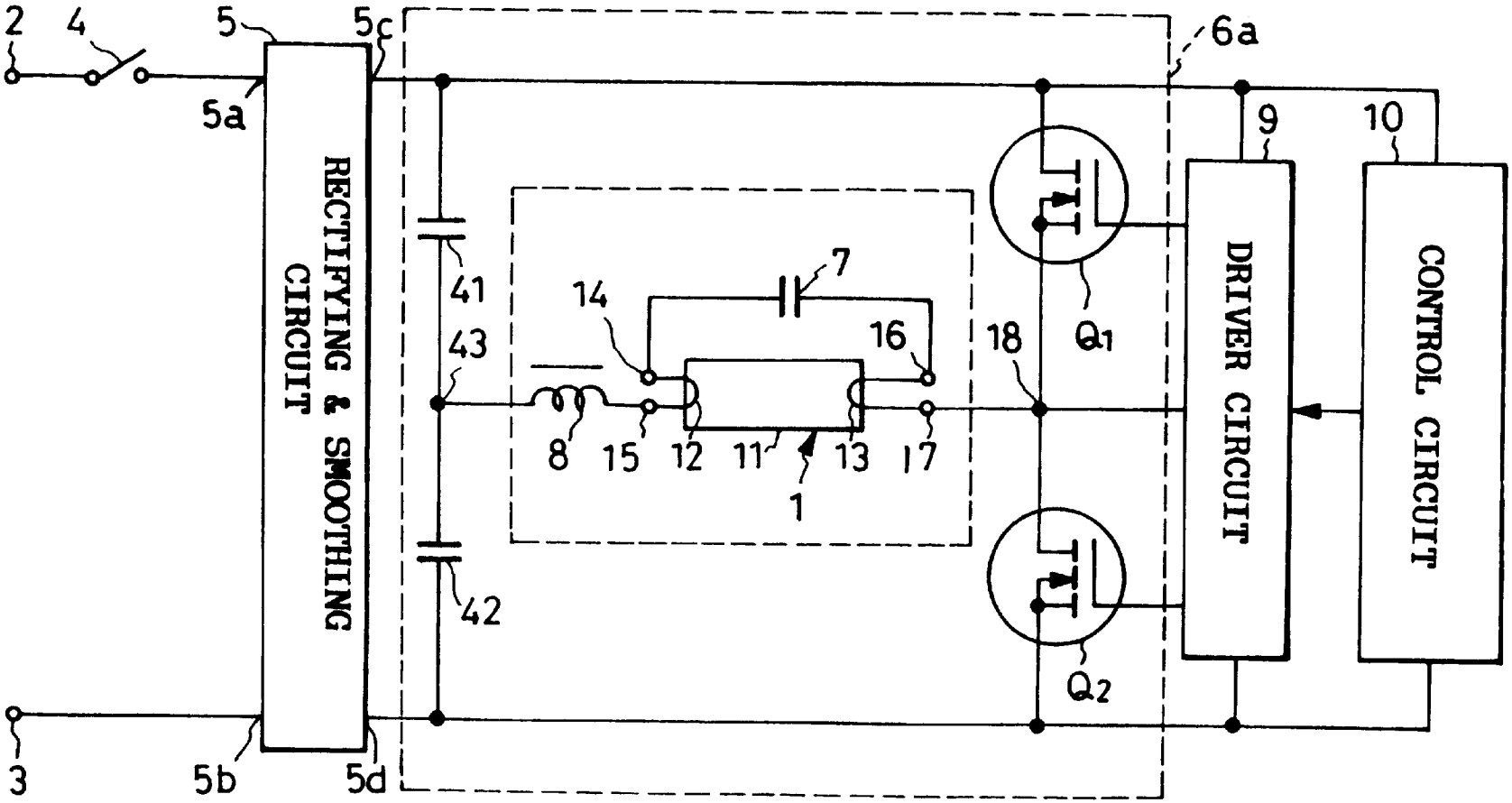
FIG. 8 is a schematic electrical diagram, partly in block form, of still another preferred form of discharge lamp lighting system according to the present invention.

The third preferred form of lamp lighting system shown in FIG. 8 features a modified inverter circuit 6*a* in substitution for the original inverter circuit 6 of the FIG. 1 system, the other details of construction being common in both systems. The modified inverter circuit 6*a* has, in addition to the pair of MOS FET switches $Q_1$ and $Q_2$, a serial circuit of two supply capacitors 41 and 42 connected across the rectifying and smoothing circuit 5. The supply capacitors 41 and 42 are therefore charged to the equal divisions of the d.c. output voltage of the rectifying and smoothing circuit 5. The serial circuit of the inverter switches $Q_1$ and $Q_2$ is connected in parallel with the serial circuit of the supply capacitors 41 and 42.

Unlike the inverter circuit 6 of the FIG. 1 or 6 system, the inverter circuit 6*a* has no coupling capacitor; instead, the fluorescent lamp 1 is connected via the resonance inductor 8 between the junction between the switches $Q_1$ and $Q_2$ and the junction between the capacitors 41 and 42. The resonance capacitor 7 is connected in parallel with the lamp 1 as in the foregoing embodiments.

As the inverter switches $Q_1$ and $Q_2$ are alternately turned on and off by the driver circuit 9 under the direction of the control circuit 10, a variable frequency signal will appear between the junctions 18 and 43 for soft-starting, preheating, lighting up, and continuously glowing the lamp 1 according to the teachings of the invention set forth in connection with the foregoing embodiments.

Fourth Form

Figure 9:
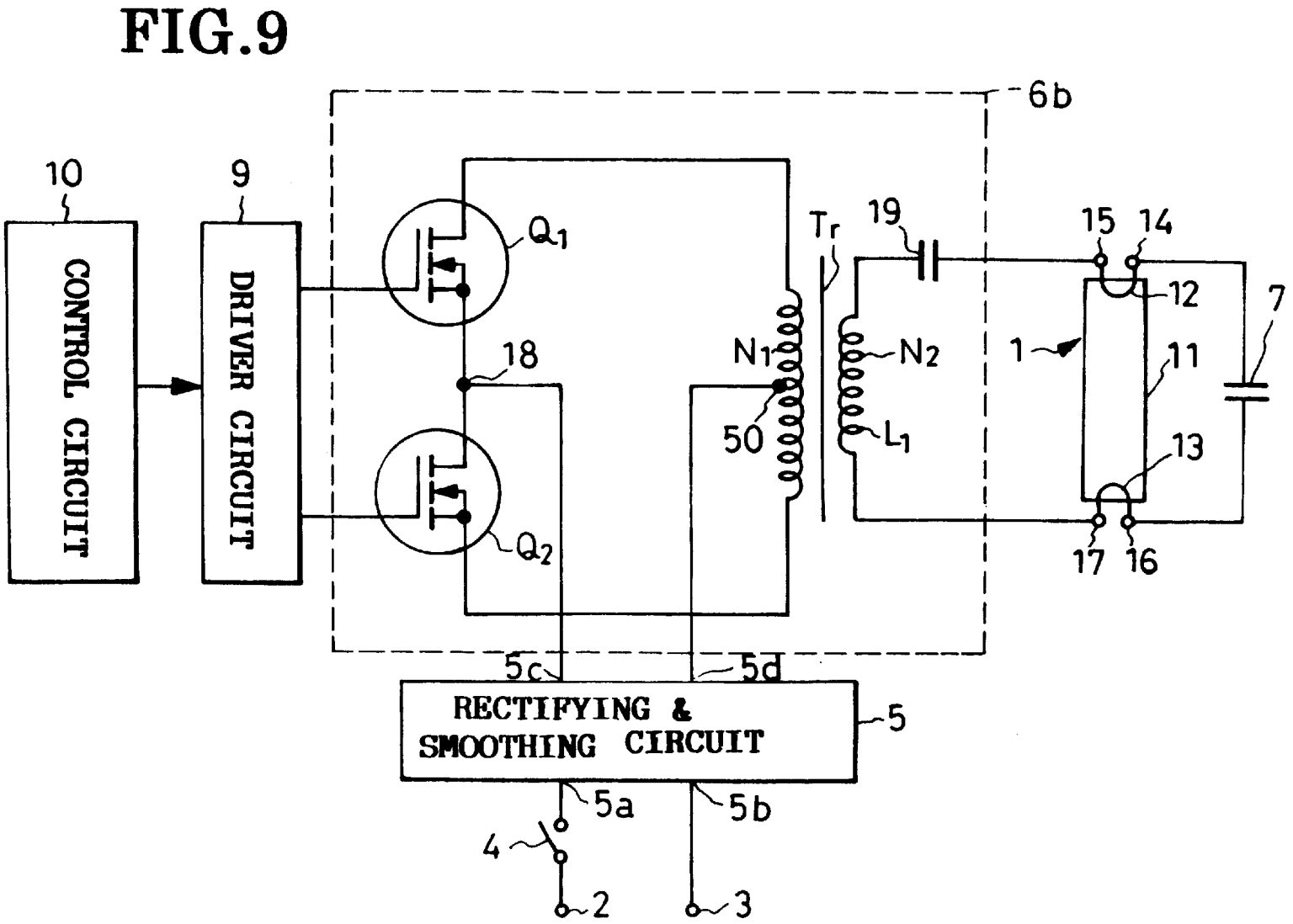
FIG. 9 is a similar diagram of a further preferred form of discharge lamp lighting system according to the present invention.

In FIG. 9 is shown a fourth preferred form of lamp lighting system featuring another modified inverter circuit 6*b*, the other details of construction being substantially, though not exactly, identical with those of the FIG. 1 system. The second modified inverter circuit 6 b is a push-pull circuit having a transformer Tr with a center-tapped primary winding $N_1$ and a secondary winding $N_2$, in addition to the pair of MOS FET switches $Q_1$ and $Q_2$.

The rectifying and smoothing circuit 5 is connected between the center tap 50 on the transformer primary $N_1$ and the junction 18 between the inverter switches $Q_1$ and $Q_2$. The transformer primary $N_1$ has its opposite extremities connected respectively to the inverter switches $Q_1$ and $Q_2$.

The transformer secondary $N_2$ has its opposite extremities connected respectively to the pair of filamentary electrodes 12 and 13 of the fluorescent lamp 1 via the coupling capacitor 19. Although the resonance capacitor 7 is connected in parallel with the lamp 1 as in all the foregoing embodiments, this system is shown to have no resonance inductor because of the presence of leakage inductance $L_1$ in the transformer secondary $N_2$. However, in cases where the leakage inductance $L_1$ does not suffice for the required resonance, a separate inductor may be provided between transformer secondary $N_2$ and lamp 1.

Despite the different construction of the inverter circuit 6 b in the FIG. 9 lamp lighting system, it will be seen that a variable frequency signal can be applied from the transformer Tr to the lamp 1 according to the teachings of this invention.

Possible Modifications

The present invention is not to be limited by the details of the embodiments disclosed herein but permits modifications such as the following:

1. Three or more, instead of two, preheat periods could be provided during which as many different inverter output frequencies were provided.
2. The soft start voltage could be incremented in discrete steps, instead of continuously as in the illustrated embodiments.
3. A further modified inverter circuit could be employed in which a single switch is connected via a primary winding of a transformer between a pair of d.c. supply terminals, providing an a.c. output voltage across the secondary winding of the transformer by on-off control of the single switch.
4. A yet further modified inverter circuit could be employed which has four switches in bridge connection.

All these and other modifications, alterations and adaptations of the illustrated embodiments are intended in the foregoing disclosure. It is therefore appropriate that the invention be construed broadly and in a manner consistent with the fair meaning or proper scope of the appended claims.

What is claimed is:

1. A lighting system for a discharge lamp having a pair of electrodes, comprising:

(a) an inverter circuit having a pair of outputs to be connected respectively to a pair of electrodes of a discharge lamp for providing a variable frequency output voltage;

(b) a resonant circuit connected to the inverter circuit and including a capacitor with which the lamp is to be connected in parallel, in order to cause an inversely frequency dependent voltage to be applied between the lamp electrodes according to a predefined resonance characteristic, the resonant circuit having a resonance frequency ($f_0$) which is less than a discharge start frequency ($f_4$) at which the lamp is to start glowing;

(c) preheat timer means for providing a preheat signal indicative of a preheat period ($T_2$+$T_3$) during which the lamp is to be preheated, (d) light up timer means for providing a lightup signal indicative of a lightup period ($T_4$) during which the lamp is to be lit up;

(e) preheat control means connected between the preheat timer means and the inverter circuit and responsive to the preheat signal for changing, during the preheat period, the frequency of the output voltage of the inverter circuit from a first frequency ($f_2$) to a second frequency ($f_3$) which is less than the first frequency, the first and the second frequencies being both higher than the discharge start frequency of the lamp and holding the lamp unlit; and (f) lightup control means connected between the lightup timer means and the inverter circuit and responsive to the lightup signal for changing, during the lightup period following the preheat period, the frequency of the output voltage of the inverter circuit from the second frequency to a third frequency ($f_5$) which is less than the discharge start frequency ($f_4$) of the lamp, the mean rate of frequency change during the lightup period ($T_4$) being higher than the mean rate of frequency change during the preheat period ($T_2$+$T_3$), in order that the lamp may start glowing by the time the output voltage of the inverter circuit reaches the third frequency;

(g) whereby the voltage impressed across the lamp is lower at the beginning than at the end of the preheat period.

2. The discharge lamp lighting system of claim 1 wherein the discharge lamp is a fluorescent lamp, and wherein the mean rate of frequency change during the preheat period ($T_2$+$T_3$) is from about 5 Hz/msec to about 20 Hz/msec, and the mean rate of frequency change during the lightup period ($T_4$) is from about 20 Hz/msec to about 40 Hz/msec.

3. The discharge lamp lighting system of claim 1 wherein the difference between the first frequency ($f_2$) and the second frequency ($f_3$) during the preheat period ($T_2$+$T_3$) is less than the difference between the second frequency and the third frequency ($f_5$) during the lightup period ($T_4$).

4. The discharge lamp lighting system of claim 1 wherein the change from the second frequency ($f_3$) to the third frequency ($f_5$) during the lightup period ($T_4$) takes place in a series of discrete steps, each frequency step having a duration (Ta) of from about 5 msec to about 100 msec.

5. The discharge lamp lighting system of claim 1 wherein the change from the second frequency ($f_3$) to the third frequency ($f_5$) during the lightup period ($T_4$) takes place in a series of discrete steps, the difference (fa) in frequency from one step to the next being less than the difference between the first frequency ($f_2$) and the second frequency ($f_3$) during the preheat period ($T_2$+$T_3$).

6. The discharge lamp lighting system of claim 5 wherein the step-by-step frequency difference (fa) during the lightup period ($T_4$) is from about 0.5 kHz to about 5.0 kHz.

7. The discharge lamp lighting system of claim 1 wherein the discharge lamp is a fluorescent lamp, and wherein the preheat period ($T_2$+$T_3$) is from about 500 msec to about 1000 msec long.

8. The discharge lamp lighting system of claim 1 wherein the discharge lamp is a fluorescent lamp, and wherein the lightup period ($T_4$) is from about 1000 msec to about 1500 msec long.

9. The discharge lamp lighting system of claim 1 further comprising:

(a) soft start timer means for providing a soft start signal indicative of a soft start period ($T_1$); and (b) soft start control means connected between the soft start timer means and the inverter circuit and responsive to the soft start signal for changing, during the soft start period, the frequency of the output voltage of the inverter circuit from a fourth frequency ($f_1$), which is higher than the first frequency ($f_2$), to the first frequency.

10. The discharge lamp lighting system of claim 8 wherein the discharge lamp is a fluorescent lamp, and wherein the soft start period ($T_1$) is from about 5 msec to about 20 msec long.

11. The discharge lamp lighting system of claim 1 further comprising:

(a) a glow signal generator for providing a glow signal indicative of a glow period ($T_5$) which follows the lightup period ($T_4$) and during which the lamp is to be kept glowing; and (b) glow control means connected between the glow signal generator and the inverter circuit and responsive to the glow signal for holding the output voltage of the inverter circuit at the third frequency ($f_5$) during the glow period.

12. The discharge lamp lighting system of claim 1 further comprising a second resonant circuit connected to the inverter circuit, the second resonant circuit including a second capacitor with which a second discharge lamp is to be connected in parallel.

13. The discharge lamp lighting system of claim 12 wherein the frequency change during the lightup period ($T_4$) takes place in a series of discrete steps, the step-by-step frequency difference (fa) being less than the difference between the first frequency ($f_2$) and the second frequency ($f_3$) during the preheat period ($T_2$+$T_3$), and wherein the lightup control means is adapted to introduce a drop (fb) in the frequency of the output voltage of the inverter circuit at the transition ($t_3$) from the preheat period to the lightup period, the frequency drop (fb) being greater than the step-by-step frequency difference (fa) during the lightup period.

14. The discharge lamp lighting system of claim 13 wherein the frequency drop (fb) in the output voltage of the inverter circuit at the transition ($t_3$) from the preheat period to the lightup period is from about two to about 20 times the step-by-step frequency difference (fa) during the lightup period.

15. The discharge lamp lighting system of claim 11 wherein the lightup control means is adapted to introduce a drop (fb) in the frequency of the output voltage of the inverter circuit at the transition ($t_3$) from the preheat period ($T_2$+$T_3$) to the lightup period ($T_4$), the frequency drop (fb) being from about 5% to about 20% of the second frequency ($f_3$).

16. The discharge lamp lighting system of claim 1 wherein the inverter circuit comprises:

(a) a pair of switches interconnected in series and to be connected across a direct current power supply; and (b) coupling means through which the discharge lamp is to be connected in parallel with one of the switches.

17. The discharge lamp lighting system of claim 1 wherein the inverter circuit comprises:

(a) a pair of capacitors interconnected in series and to be connected across a direct current power supply; and (b) a pair of switches interconnected in series and connected in parallel with the serial circuit of the capacitors;

(c) the discharge lamp being to be connected between a junction between the pair of capacitors and a junction between the pair of switches.

18. The discharge lamp lighting system of claim 1 wherein the inverter circuit comprises:

(a) a transformer having a primary winding and a secondary winding;

and (b) at least one switch through which the primary winding of the transformer is to be connected to a direct current power supply;

(c) the discharge lamp being to be connected to the secondary winding of the transformer.

* * * * *

UNITED STATES PATENT AND TRADEMARK OFFICE

CERTIFICATE OF CORRECTION

PATENT NO. : 6,140,779
DATED : October 31, 2000
INVENTOR(S) : Kanazawa et al.

It is certified that error appears in the above-identified patent and that said Letters Patent is hereby corrected as shown below:

Column 5,
Line 35, please delete "$V_{11}V_{15}$" and insert -- $V_{11}V_{16}$ -- therefor.

Signed and Sealed this

Ninth Day of October, 2001

*Attest:*

Nicholas P. Godici

NICHOLAS P. GODICI
*Acting Director of the United States Patent and Trademark Office*

*Attesting Officer*